United States Patent [19]

Takauji

[11] 4,426,903

[45] Jan. 24, 1984

[54] ELECTRONIC MUSICAL INSTRUMENT

[75] Inventor: Kiyomi Takauji, Hamamatsu, Japan

[73] Assignee: Kabushiki Kaisha Kawai Gakki Seisakusho, Japan

[21] Appl. No.: 372,050

[22] Filed: Apr. 26, 1982

[30] Foreign Application Priority Data

May 27, 1981 [JP] Japan ..... 56-80462

[51] Int. Cl.[3] ..... G10H 1/06

[52] U.S. Cl. ..... 84/1.22; 84/1.01

[58] Field of Search ..... 84/1.19, 1.21, 1.22, 84/1.23, 1.01, 1.11

[56] References Cited

U.S. PATENT DOCUMENTS 4,211,138 7/1980 Deutsch ..... 84/1.19

*Primary Examiner*—F. W. Isen

*Attorney, Agent, or Firm*—McGlew and Tuttle

[57] ABSTRACT

An electronic musical instrument in which harmonic coefficients stored corresponding to tablet signals are read out and synthesized by using a discrete Fourier transfer to form a desired musical sound. The format of cut back by a combination of a tone to be cut back, a key number and harmonic coefficient is predetermined, and based on the predetermined tone and key number respectively detected by tone detecting means and key number detecting means, the harmonic coefficient of the predetermined combination is read out, thereby to effect cutting back of the predetermined tone.

1 Claim, 10 Drawing Figures

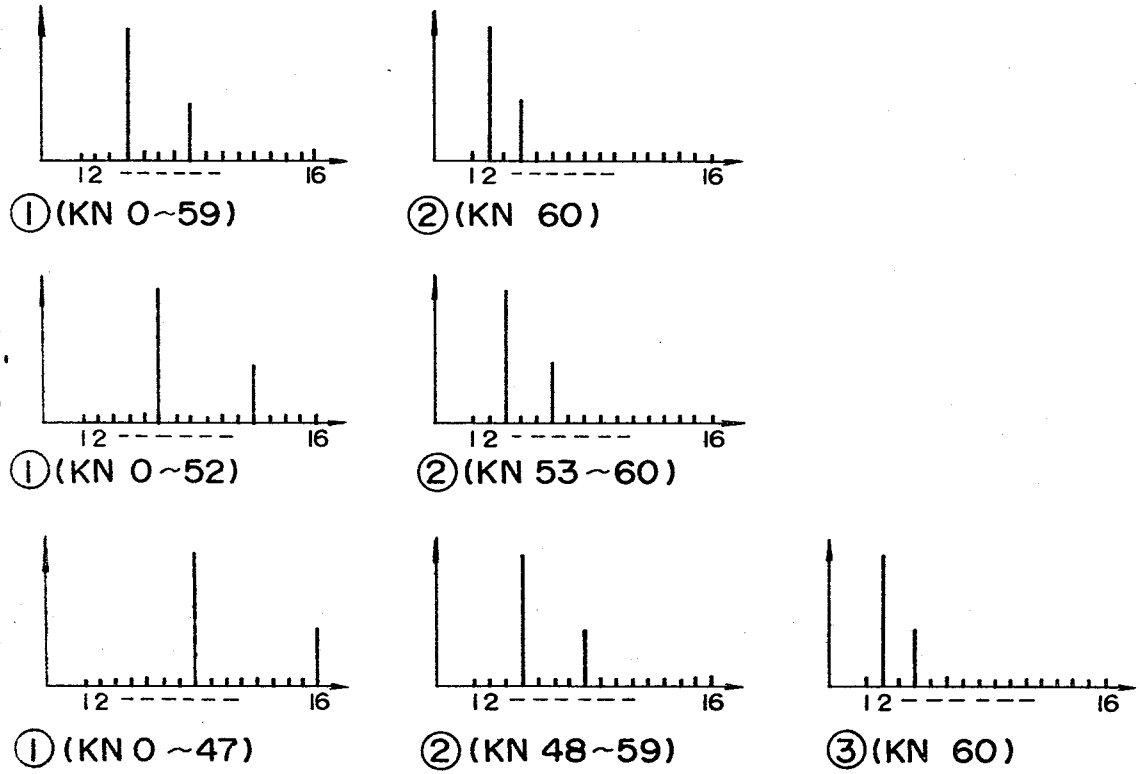
FIG. 3(d) 2'
FIG. 3(e) 1 1/3'
FIG. 3(f) 1'

FIG. 4B

| ADDRESS | 16 WORDS |
|---|---|
| 00 | ANOTHER TONE HARMONIC COEFFICIENT |
| ---------- | id |
| ---------- | id |
| ---------- | id |
| 1F | id |
| 20 | 8' HARMONIC COEFFICIENT OF FIG. 3(a) |
| 21 | 4' HARMONIC COEFFICIENT OF FIG. 3(b) |
| 22 | 2 2/3' HARMONIC COEFFICIENT OF FIG. 3(c) |
| 23 | 2' HARMONIC COEFFICIENT OF FIG. 3(d) ① |
| 24 | 1 1/3' HARMONIC COEFFICIENT OF FIG. 3(e) ① |
| 25 | 1' HARMONIC COEFFICIENT OF FIG. 3(f) ① |
| 26 | HARMONIC COEFFICIENT OF OTHER TONE |
| ---- | id |
| | id |

ELECTRONIC MUSICAL INSTRUMENT

BACKGROUND OF THE INVENTION

1. Field of the Invention

The present invention relates generally to an electronic musical instrument of the type which computes a waveshape through utilization of a discrete Fourier transfer, and more particularly to an electronic musical insturment which is adapted to repeat (or cut back) a high foot tone in a high sound range.

2. Description of the Prior Art

It is said that electronic musical instruments, especially electronic organs have been developed as a substitute for true organs. As a result of this, even at present, a tone channel called tibia or flute and a draw bar (hamond type) have different pitches or feet for the same tone. High foot tones, for example, 2, 1 3/5, $1\frac{5}{8}$, and 1 feet sounds (the foot being indicated by a numeral with a prime in the accompanying drawings), have very high musical frequencies in a high sound range. At high musical frequencies, a sense of volume disappears rapidly as is well known from the Fletcher-Munson curve. In addition, the circuit for producing high musical frequencies is large-scale and requires a high clock frequency, and hence it is very disadvantageous economically.

To avoid the abovesaid defect, it is necessary to increase the sense of volume in the high sound range for high foot tones and to eliminate the necessity of the high clock frequency. It is considered that this could be achieved by repeating or cutting back a musical sound in the high sound range. In conventional electronic musical instruments, however, when a key switch for a sound range in which to cut back a musical sound is closed, a musical note of the corresponding interval in a lower sound range is selected. Hence the key switch mechanism is complex in arrangement and control system and low in reliability, and allows easy mixing of noise because of complex wiring.

SUMMARY OF THE INVENTION

It is therefore an object of the present invention to provide a simple-structured electronic musical instrument which is of the type computing a waveshape through using a discrete Fourier transfer and which carries out what is called cut back during accumulation of harmonic coefficients.

According to the present invention, in an electronic musical instrument which is of the type computing sample point amplitude values through the use of a discrete Fourier transfer to obtain a desired waveshape, there are provided key number generating means for numbering keys of a keyboard, memory means for storing a harmonic coefficient of each tone, means for generating a tablet signal of a tone to be produced, means for detecting a cut back key number from the key number, means for detecting a cut back tone from a signal produced by the tablet signal generating means, and means for converting the tablet signal into a different tablet signal by a signal from the cut back key number detecting means and a signal from the cut back tone detecting means. A musical sound is cut back by reading out different harmonic coefficients from the memory means through using the tablet signal available from the tablet signal converting means.

BRIEF DESCRIPTION OF THE DRAWINGS

FIG. 4B is a format chart showing, by way of example, harmonic coefficient memories used in the embodiment of FIG. 4A.

DESCRIPTION OF THE PREFERRED EMBODIMENTS

According to the present invention, each keys of a keyboard is numbered and cut back processing of a high foot tone in a high sound range is carried out using the number.

Figure 1:
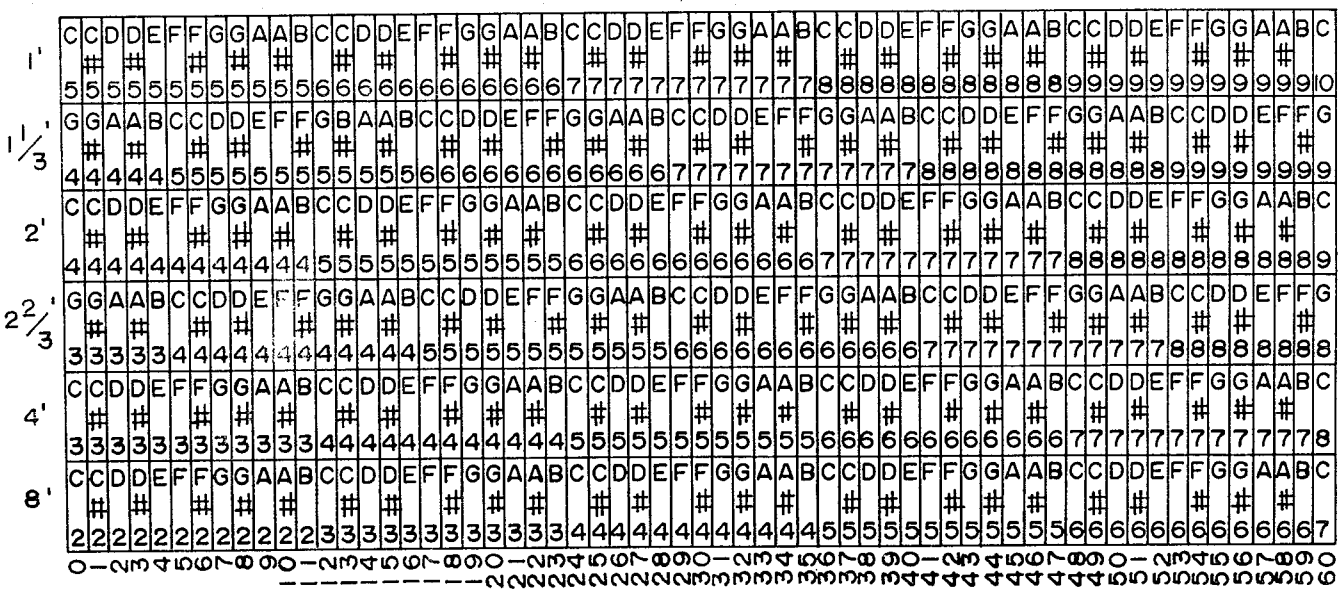
FIGS. 1, 2 and 3(*a*) through 3(*f*) are explanatory of the principle of the present invention.
Figure 2:
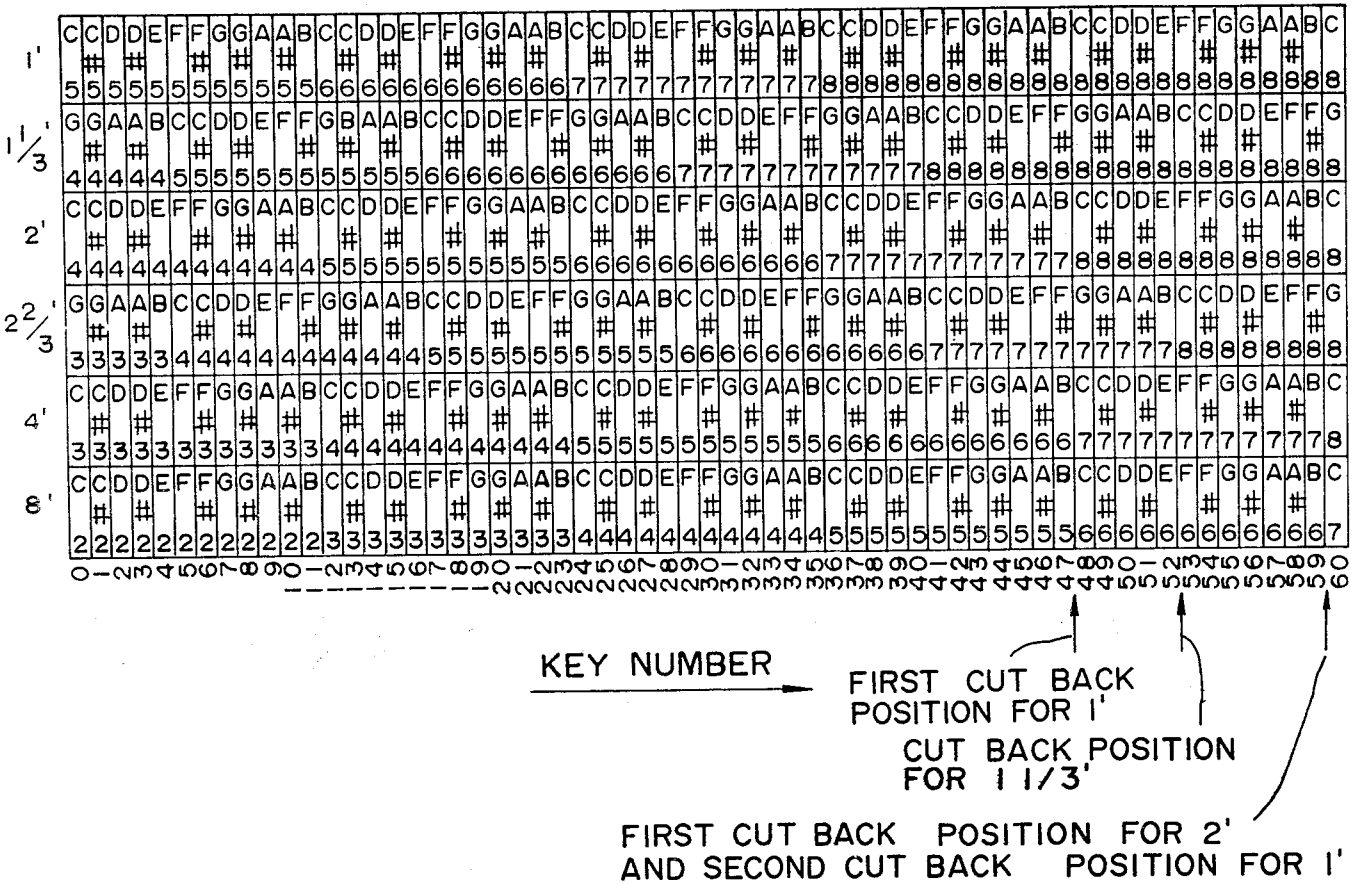
Figure 3A:
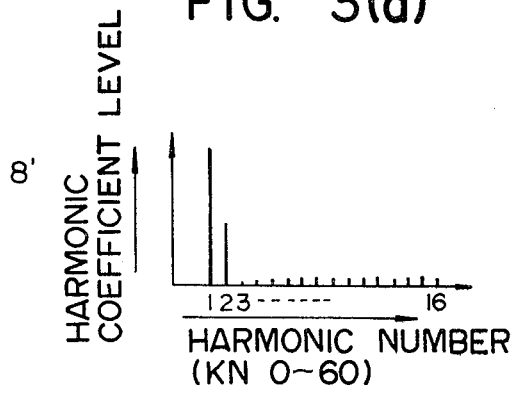
Figure 3B:
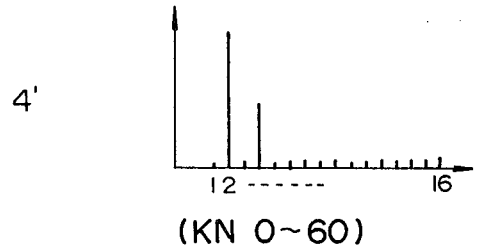
Figure 3C:
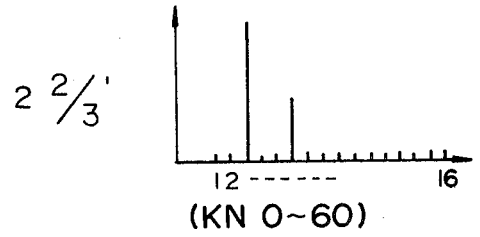

FIGS. 1, 2 and 3(*a*) through 3(*f*) are explanatory of the principle of the present invention. FIG. 1 shows the correspondence of interval of a conventional 61-key keyboard. This shows the correspondence between 8, 4, $2\frac{2}{3}$, 2, $1\frac{1}{3}$, and 1 foot tones and 61 keys in the case of the tones not being cut back. The keys of notes $C_2$ to $C_7$ (an eight foot standard) are given key numbers 0 to 60 for the purpose of comparison with the correspondence of interval according to the present invention shown in FIG. 2, and this numbering is advantageous for detecting a cut back position.

FIG. 2 is a diagram, similar to FIG. 1, showing the correspondence of interval of keys in the case of the present invention.

The correspondence of interval in FIG. 2 differs from that of FIG. 1 in that the 2, $1\frac{1}{3}$ and 1 foot tones are cut back at such positions as indicated in FIG. 2. At each cut back position, the same interval as in the immediately lower octave is repeated and the musical frequency in a high sound range of the upper limit is restricted to those of $E_8$ and lower sounds. This increases a sense of volume of the 2, $1\frac{1}{3}$ and 1 foot tones in the high sound range and permits simplification of a processing circuit.

FIGS. 3(*a*) to 3(*f*) show respective foot tones of the keys of FIG. 2 in the form of amplitudes of up to 16th harmonics.

In the case of the 8 foot tone in FIG. 3(*a*), its waveshape is synthesized using the illustrated harmonics for all the keys KN (Key Number) 0 to 60, and this tone is not cut back. The 4 foot tone in FIG. 3(*b*) and the $2\frac{2}{3}$ foot tone in FIG. 3(*c*) respectively use harmonics twice and three times higher than those of the 8 foot tone in FIG. 3(*a*), and neither of them is cut back. In contrast to them, in the case of the 2 foot tone of FIG. 3(*d*), its waveshape is synthesized through using harmonics four times higher than those of the 8 foot tone for (1) the keys KN 0 to 59 and twice higher than those of the 8 foot tone for (2) the key KN 60. This 2 foot tone is cut back. In the case of the $1\frac{1}{3}$ foot tone in FIG. 3(*e*), its waveshape is synthesized using harmonics six times higher than those of the 8 foot tone for (1) the keys KN 0 to 52 and harmonics three times higher than those of the 8 foot tone for the keys KN 53 to 60. This $1\frac{1}{3}$ foot tone is cut back. In the case of the 1 foot tone of FIG. 3(*f*), its waveshape is synthesized using harmonics eight times, four times and twice higher than those of the 8 foot tone for (1) the keys KN 0 to 47, (2) the keys KN 48 to 59 and (3) the key KN 60, respectively. This 1 foot tone is cut back.

As will be appreciated from the above, the same harmonics can be employed in common to the cases of FIGS. 3(*b*) and 3(*d*) (2) the case of FIGS. 3(*c*) and 3(*e*) (2) the cases of FIGS. 3(*d*) and (f)2, and the cases of FIGS. 3(*b*) and (f)3, respectively. Therefore, the cut back can be effected by selectively reading out, based on the key number, harmonic coefficient memories having stored therein the contents of FIGS. 3(*a*) to 3(*c*), 3(*d*) (1), 3(*e*) (1) and 3(*f*) (1). In this way, the circuit arrangement of the electronic musical instrument is simplified.

Figure 4A:
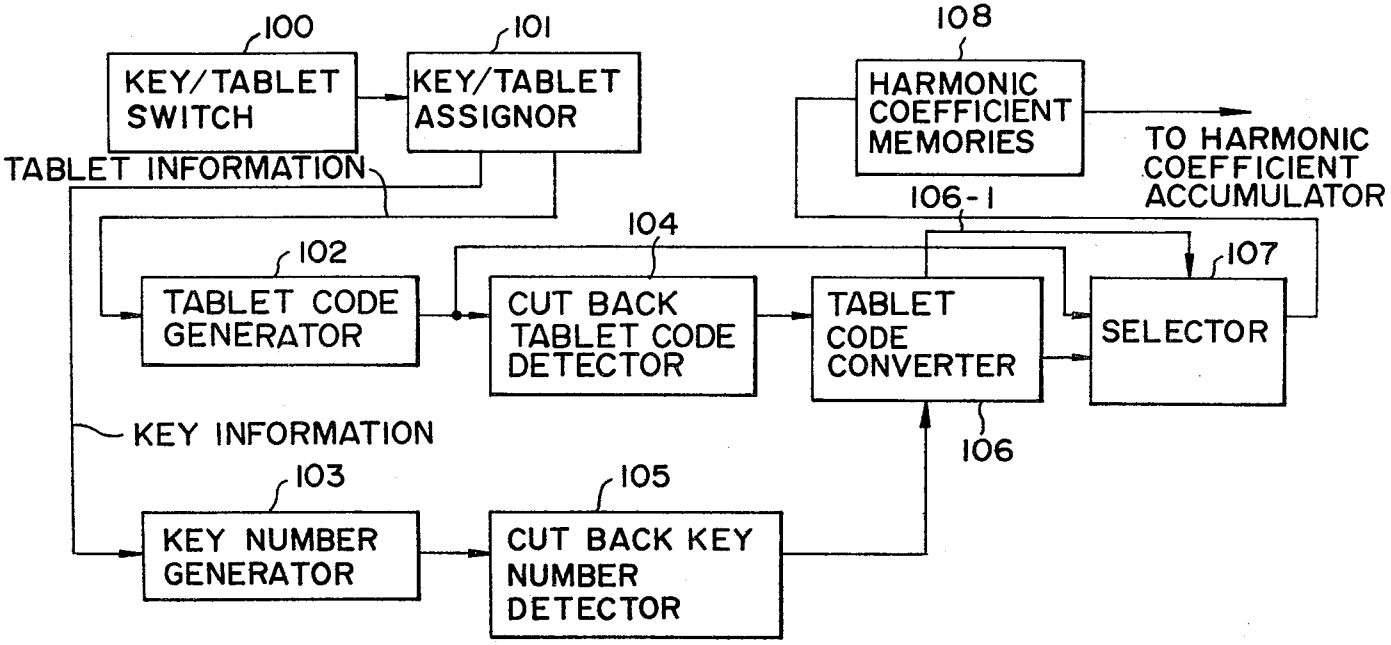
FIG. 4A is a block diagram illustrating the arrangement of a preferred embodiment of the present invention.

FIG. 4A illustrates in block form the arrangement of an embodiment of the present invention based on the principle described in the foregoing, in which harmonic coefficients are selectively read out from a harmonic coefficient memories 108. The harmonic coefficient memories 108 are read out using addresses of hexadecimal numbers "00", . . . , "1F", "20", "21" . . . , "25", . . . shown at the left-hand side of FIG. 4B. The harmonic coefficient memories 108 store the harmonic coefficients shown in FIGS. 3(*a*) to 3(*c*), 3(*d*), 1 3(*e*) 1 and 3(*f*) 1 , along with harmonic coefficients of other tones.

In FIG. 4A, a key/tablet switch 100 is a switch containing keys tablets and draw bars, and their operation signals are provided to a key/tablet assignor 101, in which the ON-OFF states of keys and tablets are assigned to output channels. Tablet information from the key/tablet assignor 101 is applied to a tablet code generator 102, wherein it is converted into a tablet code which serves as an address for reading out a desired harmonic coefficient from the harmonic memories 108. The tablet code thus obtained is supplied to a cut back tablet code detector 104, by which are detected addresses "23", "24" and "25" of tablet codes of the tones desired to cut back, such as the 2, $1\frac{1}{3}$ and 1 foot tones shown in FIGS. 3(*d*) to 3(*f*). The detected output is provided to a tablet code converter 106. On the other hand, key information from the key/tablet assignor 101 is applied to a key number generator 103, by which a key being depressed is given one of the key numbers 0 to 60 corresponding to the scales $C_2$ to $C_7$ as shown in FIGS. 1 and 2. A key number derived from the key number generator 103 is fed to a cut back key number detector 105, by which is detected the key number of a sound range in which to cut back a tone. The thus detected key number information is provided to the tablet code converter 106. Based on the cut back tablet code information from the cut back tablet code detector 104 and the cut back key number inforamtion from the cut back key number detector 105, the tablet code converter 106 yields a tablet code converted as described below.

1. The address "23" (the 2 foot tone) of the tablet code is detected by the cut back tablet code detector 104 and the key number 60 is detected by the cut back key number detector 105 and, based on these information, the tablet code converter 106 provides a tablet code "21" (the 4 foot tone).

2. The address "24" ($1\frac{1}{3}$ foot tone) is detected by the cut back tablet code detector 104 and the key numbers 53 to 60 are detected by the cut back key number detector 105 and, based on these information, the tablet converter 106 produces a tablet code "22 " (the $2\frac{2}{3}$ foot tone).

3. The address "25" (the 1 foot tone) is detected by the cut back tablet code detector 104 and the key numbers 48 to 59 are detected by the cut back key number detector 105. Based on these information, the tablet code converter 106 provides a tablet code "23" (the 2 foot tone). In the case of the key number 60 being detected, the tablet code converter 106 outputs a tablet code "21" (the 4 foot tone) based on the information.

4. In the case where none of the operations 1 to 3 is carried out, the tablet code converter 106 activates via a line 106-1 a selector 107 in a manner to select the tablet code derived form the tablet code generator 102.

As described above, only in the case where the outputs from the tablet code converter 106 and the tablet code generator 102 are applied to the selector 107 and the tablet code conversion is effected, the tablet code from the tablet code converter 106 is selected to address the harmonic coefficient memories 108. In the cases of other tablet code and key numbers, the tablet code from the tablet code generator 102 is selected to address the harmonic coefficient memories 108. The harmonic coefficient memories 108 have stored therein harmonic coefficients of many tones shown in FIG. 4B as described previously. The outputs from the memories are provided to an accumulator for accumulating harmonic of a plurality of tones, and the accumulator output and sine waves corresponding to the respective harmonics are multiplied and then a desired musical sound is synthesized through utilization of a discrete Fourier transfer.

As has been described in the foregoing, According to the present invention, in an electronic musical instrument of the type computing a musical waveshape by the employment of a discrete Fourier transfer, keys of a keyboard are each given a number and cut back processing of high foot tone in the high sound range is effected using the numbers. The use of the key numbers allows ease in the detection of a sound range in which to effect cut back operation and in the tablet code conversion. In this case, since harmonic coefficient memories as employed in the prior art are used, the memory area does not increase. Moreover, as the cut back control is carried out through using harmonic coefficients according to the system utilizing the discrete Fourier transfer, the electronic musical instrument of the present invention is highly reliable and free from mixing of noise. In the manner described in the foregoing, the highest musical frequency can be held below a predetermined scale, so that the sense of volume of high foot tones in the high sound range can be increased and, at the same time, the scale of the circuit can be made small.

Other modifications and variations are possible, and it is intended to cover all such as fall within the spirit and scope of the appended claim.

What is claimed is:

1. An electronic musical instrument which computes amplitude values of sample points by using a discrete Fourier transfer to obtain a desired waveshape to generate a tone, comprising:

key number generating means for giving key numbers to keys of a keyboard;

memory means for storing a set of harmonic coefficients for each tone to be generated;

means for generating a tablet signal for reading out from the memory means the set of harmonic coefficients of a tone to be generated;

cut back key number detecting means for detecting the key number of a sound region desired to be cut back;

cut back tone detecting means for detecting a tone desired to be cut back by a signal from the tablet signal generating means; and means for converting the tablet signal into a different tablet signal by signals from the cut back key number detecting means and the cut back tone detecting means;

wherein a set of harmonic coefficients different from those to be read out from the memory means by the signal from the tablet signal generating means are read out from the memory means by the signal from the tablet signal converting means, thereby to cut back a musical sound.

* * * * *